US005136824A

United States Patent [19]

Niedecker

[11] Patent Number: 5,136,824

[45] Date of Patent: Aug. 11, 1992

[54] APPARATUS FOR CLOSING PACKAGING SHEATHS MADE OF FLEXIBLE MATERIAL

[76] Inventor: Herbert Niedecker, Am Ellerhand 6, D 6242 Konigstein, Fed. Rep. of Germany

[21] Appl. No.: 584,316

[22] Filed: Sep. 18, 1990

[30] Foreign Application Priority Data

Sep. 21, 1989 [DE] Fed. Rep. of Germany ..... 3931465

[51] Int. Cl.[5] ..... B65B 51/04

[52] U.S. Cl. ..... 53/138.4; 53/138.3

[58] Field of Search ..... 53/138.2, 138.3, 138.4, 53/417; 29/243.56; 140/49, 57, 93 A

[56] References Cited

U.S. PATENT DOCUMENTS

| | | | |
|---|---|---|---|
| 3,293,736 | 12/1966 | Tipper | 53/138.4 X |
| 3,693,314 | 9/1972 | Reid et al. | 53/417 |
| 3,727,288 | 4/1973 | Roberts et al. | 29/243.56 X |
| 3,783,583 | 1/1974 | Dobbert | 140/93 A X |
| 3,914,980 | 10/1975 | Niedecker | 29/243.56 X |
| 4,004,339 | 1/1977 | Velarde | 29/243.56 |
| 4,043,011 | 8/1977 | Giraudi et al. | 53/138.4 X |
| 4,083,164 | 4/1978 | Hagedorn | 53/138.4 |
| 4,100,716 | 7/1978 | Barroso | 53/138.4 |
| 4,165,593 | 8/1979 | Niedecker | 53/417 X |
| 4,642,865 | 2/1987 | Kelem | 53/138.4 X |

FOREIGN PATENT DOCUMENTS

| | | |
|---|---|---|
| 1284350 | 7/1969 | Fed. Rep. of Germany . |
| 2161593 | 6/1972 | Fed. Rep. of Germany . |
| 1511725 | 9/1976 | Fed. Rep. of Germany . |
| 2045229 | 1/1979 | Fed. Rep. of Germany . |

*Primary Examiner*—Robert L. Spruill
*Assistant Examiner*—Daniel B. Moon
*Attorney, Agent, or Firm*—Sprung Horn Kramer & Woods

[57] ABSTRACT

In processes and apparatuses for closing packaging sheaths made of flexible material, particularly tubular bags, by means of a U-shaped closing clip 4, the end portion 5 of the packaging sheath which is to be closed is gathered and is introduced into a receiving space 7 between the guideways 2 for the two legs of the closing clip 4 and for a closing punch 3 and by means of said punch is closed on a female die 9 at the end of the clip-guiding guideway 2, the problem arises that particularly with bags having a highly fluid content it is complicated to feed the gathered end portion 5 of the packaging sheath to be closed laterally to the clip-guiding guideway 2 and is particularly difficult to remove the closed bag. In order to avoid said difficulties it is suggested that the bag to be closed is moved along a straigt line into an open receiving space 7 between the guideways 2 for the two legs of the closing clip 4 and that the female die 9, which is disposed laterally of the end of the clip-guiding guideway 2 is moved at right angles as far as to its closing position in a guiding groove 8 along a straight line.

2 Claims, 4 Drawing Sheets

APPARATUS FOR CLOSING PACKAGING SHEATHS MADE OF FLEXIBLE MATERIAL

BACKGROUND OF THE INVENTION

1. Field of the Invention

This invention relates to processes and apparatuses for closing packaging sheaths made of flexible material, particularly tubular bags, by means of a U-shaped closing clip, 2. Related Art In apparatuses known, e.g., from German Patent Specifications 15 11 725 and 12 85 350 the gathered end portion of the packaging sheath is laterally inserted into the receiving space between the guideways for the two legs of the closing clip and the female die is fixed in its closing position at the end of the guideway for the clip. The apparatus disclosed in German Patent Specification 15 11 725 can be used in a vertical or horizontal orientation, e.g., for closing vertically suspended, filled bags. However when vertically suspended filled bags have been closed, the bags must suitably be pulled out of the closing machine because a removal through the feed opening would be difficult. Further, the lateral feed opening must be relatively narrow because otherwise the guideway for feeding one of the legs of the closing clip would have to be interrupted for an excessively long distance so that the closing clip might be tilted. If the feed opening is relatively narrow, the removal of the closed bag opposite to the feeding direction will involve great difficulty. On the other hand, the removal of the filled and closed bag in a downward direction requires a complicated manipulation.

It is also known (DE-A2 20 45 229) that the female die can be laterally moved to a position in front of the guideway for the clip so that the female die will be swung in at the same time as the gathering arms. In that case the gathering arms and the female die are moved against the tightly filled package so that the difficulty discussed hereinbefore cannot arise.

It is also known (Published German Application 21 61 593) that an end portion of a packaging sheath can be closed in that said end portion is placed into a receiving fork and is engaged by a clip-guiding guideway of a packaging machine as that guideway descends onto the end portion of the sheath, the female die is then pivotally moved by means of a lever to a position in front of the guideway for the clip and the punch is then operated to close the closing clip on the female die around the gathered neck of the sheath. In that case considerable closing forces (about 300 kg) act via the female die on the system for imparting a pivotal movement to and for locking the female die and this results in considerable wear, which gives rise to inaccuracies.

For this reason it is an object of the invention to provide processes and apparatuses which are of the kind described hereinabove and in which the forces acting on the female die during the closing operation are not transmitted to the mechanism for actuating the female die but are directly transmitted to the body of the machine.

SUMMARY OF THE INVENTION

The apparatus for achieving such object comprises a base plate, which is provided with the guideways for the two legs of the closing clip and of the punch, an open receiving space for the feeding of the gathered end portion of the packaging sheath to be closed is defined between the guideways for the two legs of the closing clip, a female die is disposed laterally of the end of the guideway for the clip, drive means are provided for moving the female die to its closing position before the punch with the closing clip has reached its closing position, and the female die has a leading narrow portion, which bears on a support behind the guideway for the clips.

The advantage afforded by the process and the apparatus in accordance with the invention reside in that the filled bag can be grasped at its top end by one hand and can be introduced along a straight line into the open receiving space and, when the bag has been closed, the bag can be removed from the closing apparatus in the opposite direction along a straight line and can be deposited without need for a change of the grip of the hand or for additional manipulations. This is particularly desirable when bags are to be closed which are filled with a fluid and for this reason can be manipulated only with great difficulty.

A further advantage afforded by the invention resides in that the groove for guiding the female die will take up the closing forces so that there is no risk of an overstressing of the actuating mechanism. Besides, the female die can adjust itself in the closing position during the closing operation; such a self adjustment will not be possible when the female die has been swung in to its closing position.

The process in accordance with the invention is preferably carried out by means of a force-exerting drive, which causes the strokes of the punch and of the female die to be performed in the apparatus in the required sequence. The force-exerting drive may comprise a hand lever system or a system that is operated by fluid pressure.

A modification of the process in accordance with the invention, resides in the replacement of the female die which is slidably mounted laterally of the end of the guideway for the clip by a female die which is arranged at the end in closing position and which laterally yields out of the closing position against a restoring force as the gathered end portion of the packaging sheath to be closed is fed into the open receiving space. In that embodiment the gathered end of the packaging sheath is introduced against an inclined surface of the female die so that the latter will yield laterally against the restoring force and will subsequently return to its closing position. That embodiment also affords the advantage that the gathered end of the packaging sheath that is to be closed can be fed along a straight line.

BRIEF DESCRIPTION OF DRAWINGS

Details of the invention are apparent from the drawings wherein.

DESCRIPTION OF PREFERRED EMBODIMENTS

Figure 1:
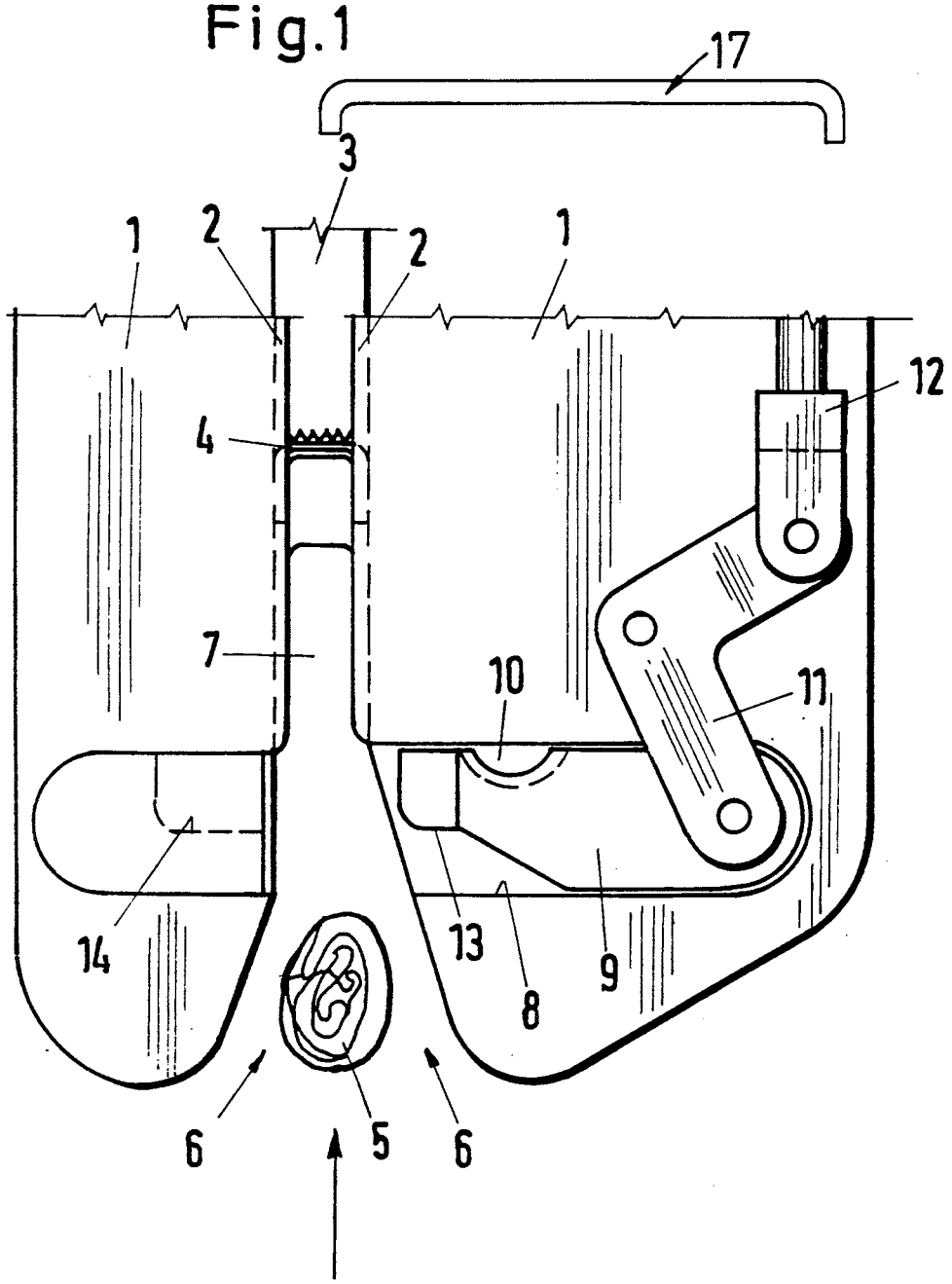
FIG. 1 is a fragmentary view of a bag-closing machine with the female die in its initial position.

Referring now more particularly to FIG. 1, there is shown a base plate 1 provided with a clip guiding guideway 2 for receiving a punch 3 and a U-shaped closing clip 4. For feeding of the gathered end portion 5 of a packaging sheath along a straight line, a conical opening 6 is provided, which merges into an open receiving space 7, into which the end portion 5 of the packaging sheath is introduced before the closing operation.

A groove 8 extending at right angles to the clip-guiding guideway 2 contains a slidably mounted female die 9 having a closing recess 10. That female die 9 in FIG. 1 is shown in an initial position in which it is laterally disposed relative to the end of the clip-guiding guideway 2. A linkage 11, 12 is so connected to the force-exerting drive for the punch 3 by a yoke 17 that the female die will lead the stroke of the punch.

Such elements 11, 12, 17 thus drive both the punch 3 and the female die 9.

Figure 2:
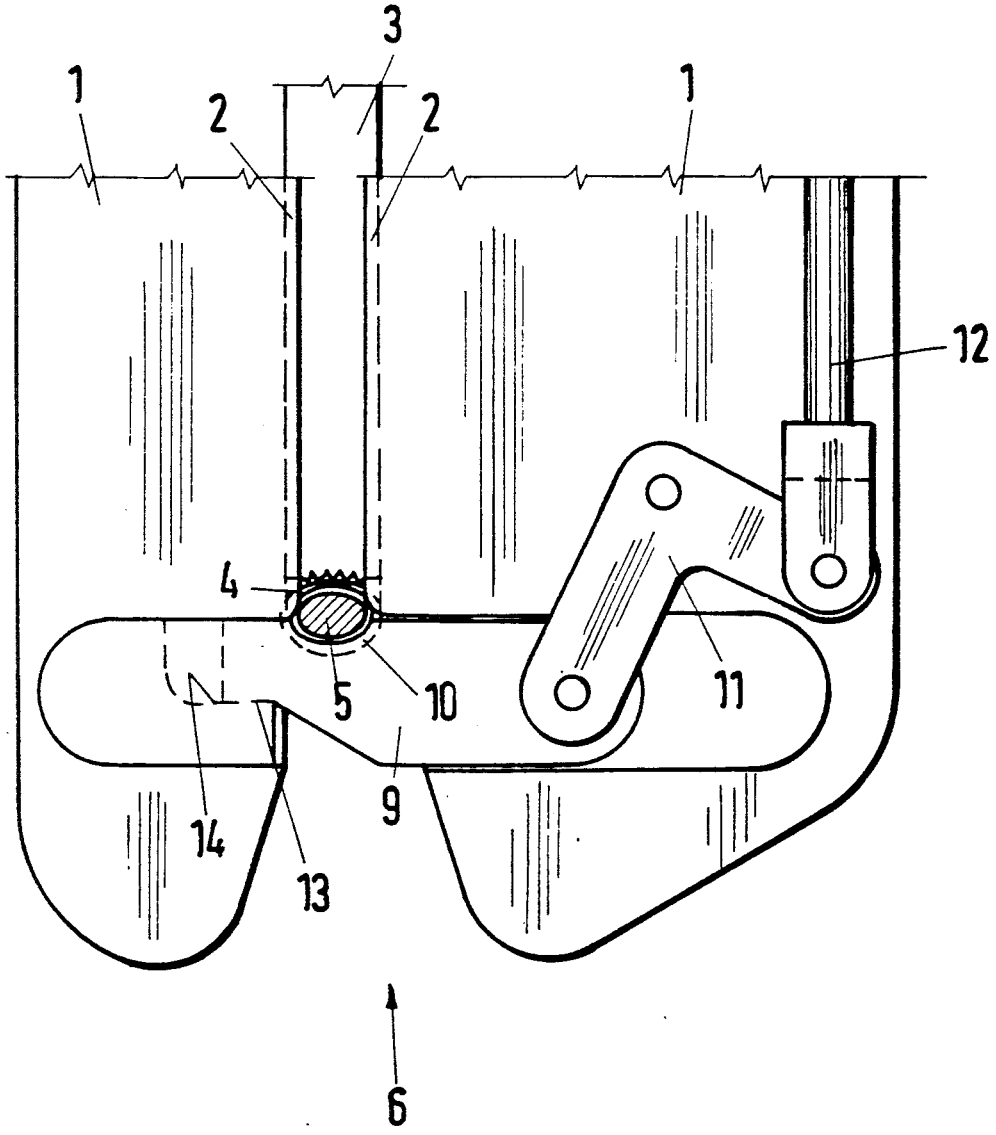
FIG. 2 shows the bag-closing machine of FIG. 1 with the female die 9 advanced to its closing position.

As shown in FIG. 2, by means of the force-exerting drive for the punch 3, a linkage 11, 12 has been actuated to move the female die 9 along a straight line at right angles as far as to its closing position. In that position a tapered portion 13 of the female die 9 bears on a support 14 behind the clip-guiding guideway 2. The punch 3 has bent the clip 4 about the neck 5 of the bag and has closed the clip. During the return stroke of punch 3 the female die 9 is returned along a straight line from the closing position to its initial position (FIG. 1) so that the closed neck 5 of the bag can be removed opposite to the feeding direction.

Figure 3:
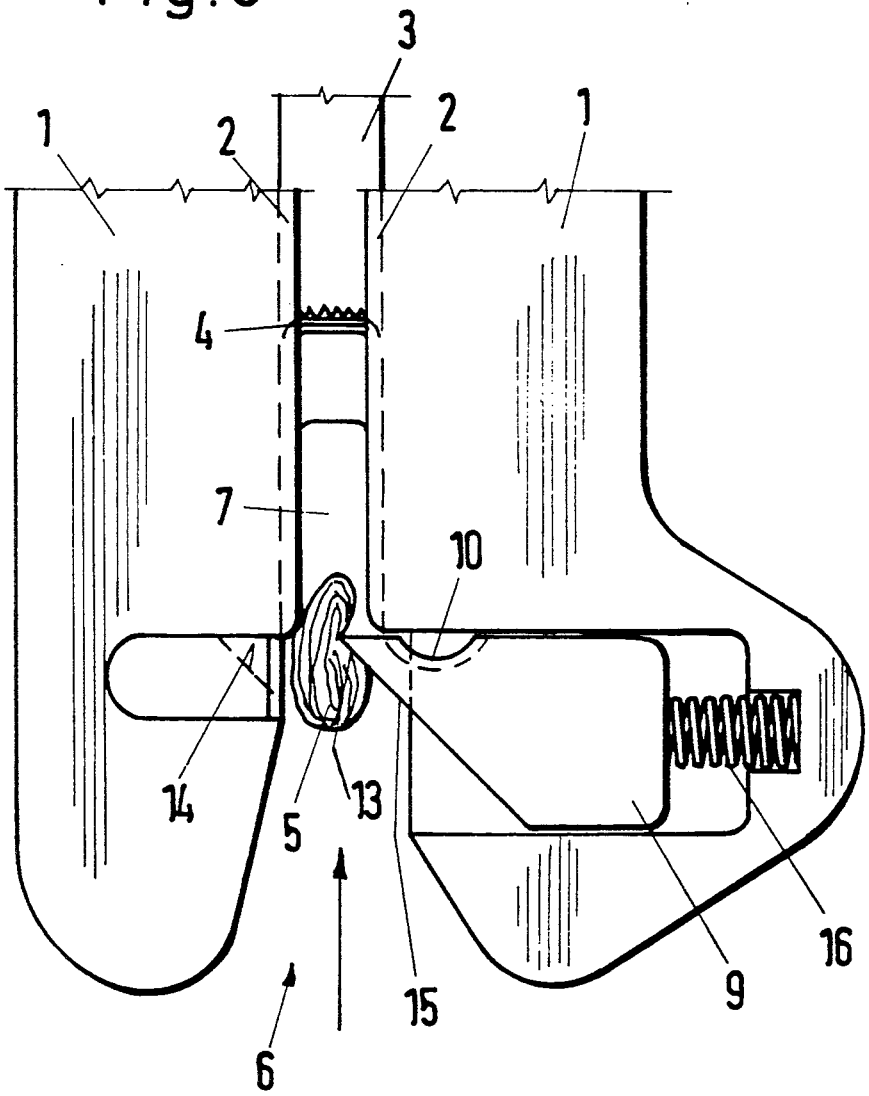
FIG. 3 is a fragmentary view showing another embodiment of a bag-closing machine in which the female die is forced back against a spring force.

In the embodiment of FIG. 3 the gathered end portion 5 of the packaging sheath has been fed into the opened receiving space 7 and has initially struck against an inclined surface 15 of the laterally displaceable female die 9 so that the latter has been forced back against the restoring force of a spring 16.

Figure 4:
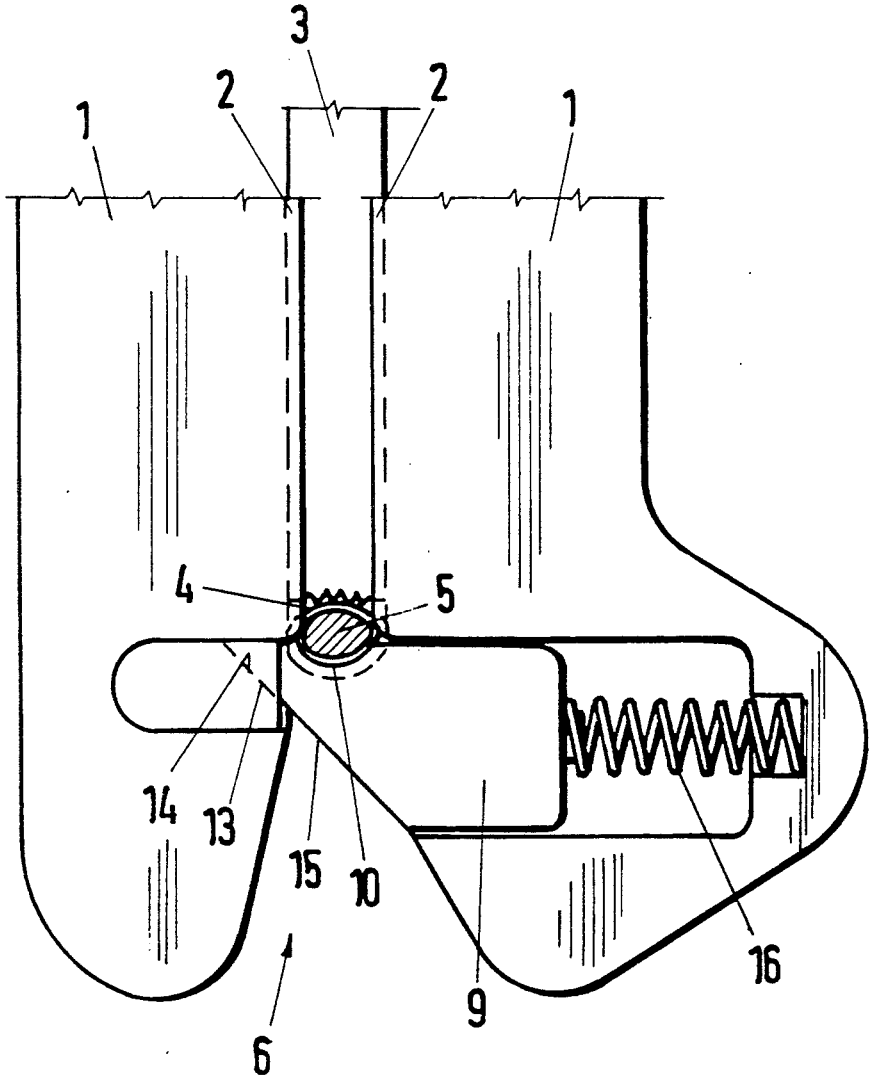
FIG. 4 shows the bag-closing machine of FIG. 3 in its closing position.

As shown in FIG. 4, when the gathered end 5 of the bag has moved past the inclined surface 15 of the female die 9, the female die 9 springs back to its closing position under the restoring force of the spring 16 while the tapered portion 13 of the female die 9 bears on the support 14. In this embodiment the female die 9 need not be actuated by the force-exerting drive.

When the ram 3 has moved out of its closing position, the closed neck 5 of the bag can be removed downwardly.

It will be appreciated that the instant specification is set forth by way of illustration and not limitation, and that various modifications and changes may be made without departing from the spirit and scope of the present invention.

What is claimed is:

1. An apparatus for the closing of a crimped packaging sheath made of a flexible material by means of a U-shaped two-legged closing clip, the apparatus comprising a frame member having first and second legs and a mouth, the legs defining therebetween a guideway for the clip, and the mouth providing an entrance for the crimped packaging sheath to be closed, a rectilinear slot extending crossways of said guideway adjacent said mouth and extending into both legs of the frame member, a displaceable die member in said first leg in said slot, said die member being provided with a recess so that upon displacement of said die member said recess spans said guideway, means for supporting said die member in said second leg, means for displacing said die member from an initial position solely in said first leg to a supported position in both legs, and then back to said initial position, a punch positioned in said guideway in position to advance said clip toward said mouth, and means for displacing said punch so as to advance said clip in said guideway to effect closing, and for thereafter returning the punch to its starting position.

2. An apparatus according to claim 1, including common drive means for the punch and the die.

* * * * *